US006745818B1

(12) United States Patent
Fan et al.

(10) Patent No.: US 6,745,818 B1
(45) Date of Patent: Jun. 8, 2004

(54) METHOD AND APPARATUS FOR PRODUCING SEMISOLID METHOD SLURRIES AND SHAPED COMPONENTS

(75) Inventors: Zhongyun Fan, Uxbridge (GB); Michael John Bevis, Uxbridge (GB); Shouxun Ji, Uxbridge (GB)

(73) Assignee: Brunel University (GB)

( * ) Notice: Subject to any disclaimer, the term of this patent is extended or adjusted under 35 U.S.C. 154(b) by 0 days.

(21) Appl. No.: 10/088,877

(22) PCT Filed: Sep. 15, 2000

(86) PCT No.: PCT/GB00/03552

§ 371 (c)(1),
(2), (4) Date: Aug. 5, 2002

(87) PCT Pub. No.: WO01/21343

PCT Pub. Date: Mar. 29, 2001

(30) Foreign Application Priority Data

Sep. 24, 1999 (GB) ..... 9922695

(51) Int. Cl.[7] ..... B22D 17/00

(52) U.S. Cl. ..... 164/113; 164/900; 164/312; 366/83; 366/88

(58) Field of Search ..... 164/113, 900, 164/312; 366/83, 88

(56) References Cited

U.S. PATENT DOCUMENTS

| | | | | |
|---|---|---|---|---|
| 4,694,881 A | | 9/1987 | Busk | |
| 4,694,882 A | | 9/1987 | Busk | |
| 5,322,111 A | * | 6/1994 | Hansma | 164/312 |
| 5,685,357 A | | 11/1997 | Kato et al. | |
| 5,711,366 A | | 1/1998 | Mihelich et al. | |
| 5,735,333 A | | 4/1998 | Nagawa | |
| 5,836,372 A | * | 11/1998 | Kono | 164/113 |
| 6,308,768 B1 | * | 10/2001 | Rice et al. | 164/133 |

FOREIGN PATENT DOCUMENTS

| | | |
|---|---|---|
| CA | 2164759 A1 | 6/1997 |
| EP | 0867246 A1 | 9/1998 |
| GB | 2 263 429 A | 7/1993 |
| GB | 2 276 831 | 10/1994 |
| GB | 2 354 471 A | 3/2001 |
| GB | 2 354 472 A | 3/2001 |
| JP | 01 087041 A | 3/1989 |
| JP | 02 023833 A | 1/1990 |
| WO | WO 90/09251 A1 | 8/1990 |
| WO | WO 95/34393 A1 | 6/1997 |
| WO | WO 97 21509 | 6/1997 |
| WO | WO 02/13993 A1 | 2/2002 |

OTHER PUBLICATIONS

Fleming, Merton C., Behavior of Metal Allows in the Semisolid State, The 1990 Edward Campbell Memorial Lecture, ASM International, *2207 Metallurgical Transactions B*, 22B (1991) Jun., No. 3, Warrandale, PA, US.

Tisser A. et al., "Magnesium Rheocasting: A Study of Processing–Microstructure Interactions," *Journal of Materials Science*, Chapman and Hall Ltd., London, GB, vol. 25, No. 2B, Feb. 1, 1990, pp. 1184–1196.

* cited by examiner

*Primary Examiner*—Kiley Stoner
*Assistant Examiner*—Len Tran
(74) *Attorney, Agent, or Firm*—Craig A. Bieschko, Esq.; DeWitt Ross & Stevens S.C.

(57) ABSTRACT

A method and apparatus for converting liquid alloy into its thixotropic state and for fabricating high integrity components by injecting subsequently the thixotropic alloy into a die cavity. The apparatus includes a liquid metal feeder, a high shear twin-screw extruder, a shot assembly and a central control system. The apparatus and method can offer net-shaped components characterized by close to zero porosity, fine and equiaxed particles with a uniform distribution in the eutectic matrix, and a large range of solid volume fractions.

24 Claims, 7 Drawing Sheets

METHOD AND APPARATUS FOR PRODUCING SEMISOLID METHOD SLURRIES AND SHAPED COMPONENTS

BACKGROUND OF THE INVENTION

This invention relates to an apparatus and method for forming a shaped component from liquid metal alloy. In particular, it relates to a method and apparatus for converting liquid alloy into semisolid slurry which is injected subsequently into a die cavity to produce shaped components. The apparatus and method are applicable to light alloys, such as aluminum alloy, magnesium alloy, zinc alloy and any other alloy suitable for semisolid processing.

One of the conventional methods used to manufacture metallic components is die casting. In the conventional die casting process, the liquid metal is usually forced into a mold cavity at such a high speed that the flow becomes turbulent or even atomized. As a result, air is often trapped within the cavity, leading to high porosity in the final components, which reduces the component strength and can cause component rejection if holes appear on the surface after machining. Moreover, components with high porosity are unacceptable because they are usually not heat-treatable, thus limiting their potential applications.

Intuitively, the porosity due to turbulent or atomized flow could be reduced or even eliminated if the viscosity of the metal flow could be increased to reduce the Reynolds number sufficiently so trapped air is minimized, somewhat similar to the injecting molding of plastics. However, it was not clear how this could be achieved until the early 1970s when Metz and Flemings proposed the concept of semisolid material (SSM) processing. They suggested that, if metal solidification is carried out in the semisolid state, the porosity of castings could be reduced significantly. The study of Spencer et al showed that when molten metal is agitated during cooling below its liquidus temperature, the dendritic primary solid would be broken into near spherical particles suspended in the liquid metal matrix. The exponentially increased viscosity with the solid fraction of such a semisolid slurry can produce sound castings with die casting process. The SSM process improves upon the die casting method by injecting semisolid metal rather than fully liquid metal into a die cavity for component production. Compared with conventional die casting routes, SSM processing has the following advantages: (1) cost effectiveness over the whole manufacturing cycle; (2) near-net shape processing; (3) consistency and soundness of mechanical properties; (4) ability to make complex component shapes; (5) weight reduction through alloy substitution and more efficient use of materials; (6) high production rate; (7) enhanced die life; (8) less environmental cost. The enhanced mechanical properties result from the improved microstructural features, such as refined grain size, non-dendritic morphology and substantially reduced porosity level.

Although the concept of SSM processing seems promising, the major problem remains as how the slurry is produced and how the component is shaped efficiently and reliably. Since the early 1970s, a number of alternatives to the original MIT rheocasting process have been developed. One of the most popular processes currently used is thixoforming, in which pre-processed nondendritic alloy billet are reheated to the semisolid region prior to the shaping process. It is therefore a two-stage process. The high cost of pre-processed non-dendritic raw materials and of the re-heating process are by far the greatest obstacles to the development of the full potential of this approach. In addition, plastic injection molding techniques have recently been introduced into the SSM processing field. One process is "thixomolding" for Mg-alloys, which was developed by Dow Chemicals and currently marketed by Thixomat, the other one was developed at Cornell University (USA). However, the quality of both semisolid slurries and final components is not totally satisfactory.

During the last 20 years, the most active method of producing semisolid slurry is mechanical agitation. Unfortunately, most mechanical stirring methods have not gained popularity in industry because of the problems associated with erosion of the stirring device, problems with synchronisation of the stirring with the continuous casting process, and the inadequate shear rate to obtain fine particles.

A number of references disclose thixomolding processes, in which a solid or semisolid feed is first processed (for example by heating the feed to liquefy it whilst subjecting it to shear) and then injected into a mold to form a component. Examples of such references include: EP 0867246 A1 (Mazda Motor Corporation); WO 90/09251 (The Dow Chemical Company); U.S. Pat. No. 5,711,366 (Thixomat, Inc.); U.S. Pat. No. 5,735,333 (The Japan Steel Works, Limited); U.S. Pat. No. 5,685,357 (The Japan Steel Works, Limited); U.S. Pat. No. 4,694,882 (The Dow Chemical Company); and CA 2,164,759 (Inventronics Limited).

The disadvantage however with heating solid granules in order to convert them into the thixotropic state (thixomolding) rather than cooling liquid metal into the thixotropic state (rheomolding) is that it is very difficult to control particle size and particle size distribution in the sub-structure of the thixotropic slurry. Specifically, particle sizes of thixomolded slurries tend to be an order of magnitude larger than those of rheomolded slurries, and to have a wider sized distribution. This has negative implications for the structural properties of the casted components.

Furthermore, the above-mentioned references employ a standard single screw extruder for subjecting the thixotropic slurry to shear. The result is a component of low quality.

A number of references do disclose rheomolding processes. For example, WO 97/21509 (Thixomat, Inc.) relates to a process for forming metal compositions in which an alloy is heated to a temperature above its liquidus temperature, and then employing a single screw extruder to shear the liquid metal as it is cooled into the region of two phase equilibrium.

U.S. Pat. No. 4,694,881 (The Down Chemical Company) relates to a process in which a material having a non-thixotropic-type structure is fed in solid form into a single screw extruder. The material is heated to a temperature above its liquidus temperature, and then cooled to a temperature lower than its liquidus temperature and greater than its solidus temperature whilst being subjected to a shearing action.

WO 95/34393 (Cornell Research Foundation, Inc.) also discloses a rheomolding process in which super-heated liquid metal is cooled into a semisolid state in the barrel of a single screw extruder, where it is subjected to shear whilst being cooled, prior to being injection molded into a cast.

None of the thixomolding or rheomolding references describe a process which enables components of a sufficiently high structural integrity to be formed.

SUMMARY OF THE INVENTION

The primary objective of this invention is to provide an apparatus and method which converts liquid alloy into its thixotropic state and fabricates high integrity components by injecting subsequently the thixotropic alloy into a mold cavity in an integrated one-step process.

Another objective of the invention is to provide an apparatus and method which is specially adapted for producing semisolid metal alloys with a highly corrosive and erosive nature in their liquid or semisolid state.

Still another objective of the invention is to provide an improved die casting system suitable for production of high integrity components from semisolid slurry.

In a first aspect of the invention, there is provided a method for forming a shaped component from liquid metal alloy, comprising the steps of cooling the alloy to a temperature below its liquidus temperature whilst applying shear at a sufficiently high shear rate and intensity of turbulence to convert the alloy into its thixotropic state, and subsequently transferring the alloy into a mold to form a shaped component, wherein shear is applied to the alloy by means of an extruder having at least two screws which are at least partially intermeshed.

In a second aspect of the present invention, there is provided a method of forming a semisolid slurry from a liquid metal alloy, comprising the steps of cooling the alloy below its liquidus temperature whilst applying shear at a sufficiently high shear rate and intensity of turbulence to convert the alloy into its thixotropic state, wherein shear is applied to the alloy by means of an extruder having at least two screws which are at least partially intermeshed.

The realization of the present invention is that a shaped component of a particularly high quality can be formed by employing at least two screws to apply shear to the alloy, the screws being at least partially intermeshing.

Preferably, the extruder is a twin-screw extruder in which the twin screws are substantially fully intermeshed.

The use of single screw extruders are well known in the art, but the use of a twin screw extruder in a process such as this is thought to be novel. Each screw generally has a shaft which is aligned with the barrel of the extruder, and a series of flights or vanes disposed along the shaft. These flights or vanes may be connected in a spiral or helical manner to form a continuous thread down the shaft. The form may be varied depending on the desired effect.

The at least two screws should be at least partially intermeshed. By this it is meant that the flights or vanes on one screw should at least partially overlap with the flights or vanes on the other screw with respect to the longitudinal axis of movement of the alloy through the extruder. Thus, in a preferred embodiment, two screws each having a continuous spiralled vane down the screw shaft are disposed such that the vanes overlap along the "line of sight" of the longitudinal axis of the shafts, which are aligned with the longitudinal axis of the extruder barrel.

In a third aspect of the invention, there is provided apparatus for forming a shaped component from liquid metal alloy, comprising a temperature-controlled extruder able to impart sufficient shear and intensity of turbulence to a liquid metal alloy to convert it into its thixotropic state, a shot assembly in fluid communication with the extruder, and a mold in fluid communication with the shot assembly, wherein the extruder has at least two screws which are at least partially intermeshed.

In the fourth aspect of the invention, there is provided an improved die casting system suitable for production of high integrity components from semisolid slurry, comprising a temperature-controlled extruder able to impart sufficient shear rate and intensity of turbulence in fluid communication with the extruder, and a mold in fluid communication with the shot assembly.

In the inventive process the steps of melting the alloy, converting the alloy into its thixotropic state and injecting the thixotropic alloy into a die cavity are preferably carried out at physically separated functional units. The inventive apparatus preferably consists of a liquid metal feeder, a high shear twin-screw extruder, a shot assembly and a central control system. The rheomolding process starts from feeding the liquid metal from the melting furnace into a twin-screw extruder. The liquid metal is rapidly cooled to the SSM processing temperature in the first part of the extruder while being mechanically sheared by twin-screws, converting the liquid alloy into a semisolid slurry with a pre-determined volume fraction of the solid phase dictated by accurate temperature control. The semisolid slurry is then injected at a high velocity into a mold cavity through the shot assembly. The fully solidified component is finally released from the mold. All these procedures are performed in a continuous cycle and controlled by a central control system.

The said method can offer semisolid slurries with fine and uniform solid particles and with a large range of solid volume fractions (5% to 95%, preferably 15% to 85%). The said apparatus and method can also offer net-shaped metallic components with the porosity being close to zero. The said method preferably comprises the steps of:

(a) providing said alloy in the liquid state and pouring said liquid alloy to a temperature-controlled extruder through a feeder;

(b) converting said liquid alloy to its thixotropic state by the high shear rate offered by an extruder with at least two at least partially intermeshed screws.

(c) transferring said thixotropic alloy from the extruder into a shot sleeve by opening a control valve located at one end of the extruder; and (d) injecting said thixotropic slurry from the shot sleeve into a mold cavity by advancing a piston at sufficient speed.

Generally, the feeder is used to supply liquid alloy at the desired temperature to the extruder. The feeder can be a melting furnace or a ladle and a connecting tube. The feeding hose can be controlled by a valve located in the connecting tube, or a positive or negative pressure controller.

Generally, the twin-screw extruder, consisting of a barrel, a pair of at least partially screws and a driving system, is adapted to receive liquid metal through an inlet located generally toward one end of the extruder. Once in the passageway of the extruder, liquid alloy is either cooled or maintained at a predetermined temperature. In either situation, the processing temperature is above the material solidus temperature and below its liquidus temperature so that the alloy is in the semisolid state in the extruder.

The processing temperature, which as stated depends upon the liquidus and solidus temperatures of the alloy, will vary from alloy to alloy. The appropriate temperature will be apparent to one skilled in the art. As an example, for the alloy Al-7 wt % Si-0.5% Mg (that is aluminum with 7 wt % silicon and 0.5 wt % w/w magnesium), the alloy should be poured into the extruder at a temperature of from 650° C. to 750° C., and should be processed in the extruder at a temperature of from 560° C. to 610° C.

In the extruder, the alloy is subjected to shearing. The shear rate is such that it is sufficient to prevent the complete formation of dendritic shaped solid particles in the semisolid state. The shearing action is induced by a pair of co-rotating screws located within the barrel and is further invigorated by helical screw flights formed on the body of the screws. Enhanced shearing is generated in the annular space between the barrel and the screw flights and between the flights of two screws.

The fluid flow of the liquid alloy or semisolid slurry in the twin screw extruder is characterized by figure "8" motions around the periphery of the screws, which moves from one pitch to the next one, forming a figure "8" shaped helix and pushing the fluid along the axial direction of the screws. This is referred as the positive displacement pumping action. In this continuous flow field, the fluid undergoes cyclic stretching, folding and reorienting processes with respect to the streamlines during the take-over of the materials from one screw to the other one. Meanwhile, fluid flow in the closely intermeshing twin-screw extruder is the circular flow pattern on the axial section, which could create high intensity of turbulence for low viscosity liquid metals and/or semi-solid metals. In addition, the fluid in the extruder is subjected to a cyclic variation of shear rate due to the continuous change in the gap between the screw and the barrel, which causes the material in the extruder to undergo a shear deformation with cyclic variation of shear rate. Therefore, the fluid flow in a closely intermeshing, self-wiping and co-rotating twin-screw extruder is characterized by high shear rate, high intensity of turbulence and cyclic variation of shear rate.

Unlike the viscous drag-induced type flow of materials transported in a single screw extruder, such as employed in prior art processes, the transport behavior in a closely intermeshing twin-screw extruder is to a large extent a positive displacement type of transport, being more or less independent of the viscosity of the materials. The velocity profiles of materials in a twin-screw extruder are quite complex and more difficult to describe. There are basically four groups of forces. The first group relates to the scales of inertia forces and centrifugal forces; the second group concerns the scale of gravity force; the third comprises the scale of internal friction and the fourth group refers to the scales of elastic and plastic deformation behavior of the materials being processed. The principal forces acting on the liquid or semi-solid alloys during the rheomolding process between two screws and between screw and barrel are compression, rupture, shear and elasticity.

It has been found that shear rates of 5000–10,000 $s^{-1}$ can be achieved with a twin screw extruder, which results in greatly improved results. However, if the intensity of turbulence is sufficiently high, these improved results can be achieved with shear rates of perhaps 400 $s^{-1}$.

The interior environment of the twin-screw extruder is characterized by high wear, high temperature and complex streses. The high wear is a result of the close fit between the barrel and the screws as well as between the screws themselves. Therefore, a suitable material for the barrel and screws and other components must exhibit good resistance to wear, high temperature creep and thermal fatigue. The interior environment of the extruder is also highly corrosive and erosive. This is caused by the high reactivity of liquid or semisolid metals such as aluminum which can dissolve and/or erode most metallic materials. After intensive tests and evaluation, the present invention has developed a novel machine construction which allows highly corrosive and erosive materials, such as aluminum magnesium, copper and zinc alloys to be conditioned into their thixotropic state without any significant degradation of the machine itself.

The barrel of the twin-screw extruder is constructed with an outer layer of a creep resistant first material which is lined by an inner layer of a corrosion and erosion resistant second material.

Preferably, the outer layer material is H11, H13 or H21 steel and the inner layer material is sialon. Bonding of the inner layer and outer layer is achieved by either shrink fitting or with a buffer layer between the two. The barrel of the extruder can also be constructed with a single piece of sialon, which is more convenient for a small machine.

The twin-screw is positioned within the passageway of the extruder. The rotation of the screws subjects the molten alloy to high shear and translates the material through the barrel of the extruder. The screw is constructed with sialon components that are mechanically or physically bonded together to gain maximum resistance to creep, wear, thermal fatigue, corrosion and erosion. Additional components of the extruder, including the outlet pipe, outlet valve body and valve core, are also constructed from sialon. The twin-screw extruder is driven by either an electrical motor or hydraulic motor through a gearbox to maintain the desired rotation speed.

The shot sleeve can be either closely connected with one end of the extruder or separately positioned in the shot assembly to receive the semisolid slurry from the extruder. The semisolid slurry in the shot sleeve can be injected at high speed to a mold cavity by moving a piston through the cylinder.

BRIEF DESCRIPTION OF THE DRAWINGS

A number of preferred embodiments of the invention are described in detail below with reference to the drawings, in which.

DETAILED DESCRIPTION OF PREFERRED VERSIONS OF THE INVENTION

In the description of the preferred embodiment which follows, a die casting is produced by a twin-screw rheomolding machine from aluminum (Al) alloy ingot. The invention is not limited to Al alloys and is equally applicable to any other types of alloys, such as magnesium alloys, zinc alloys and any other alloy suitable for semisolid metal processing. Furthermore, specific temperatures and temperature ranges cited in the description of the preferred embodiment are only applicable to Al-alloys, but could be readily modified in accordance with the principles of the invention by those skilled in the art in order to accommodate other alloys.

Figure 1:
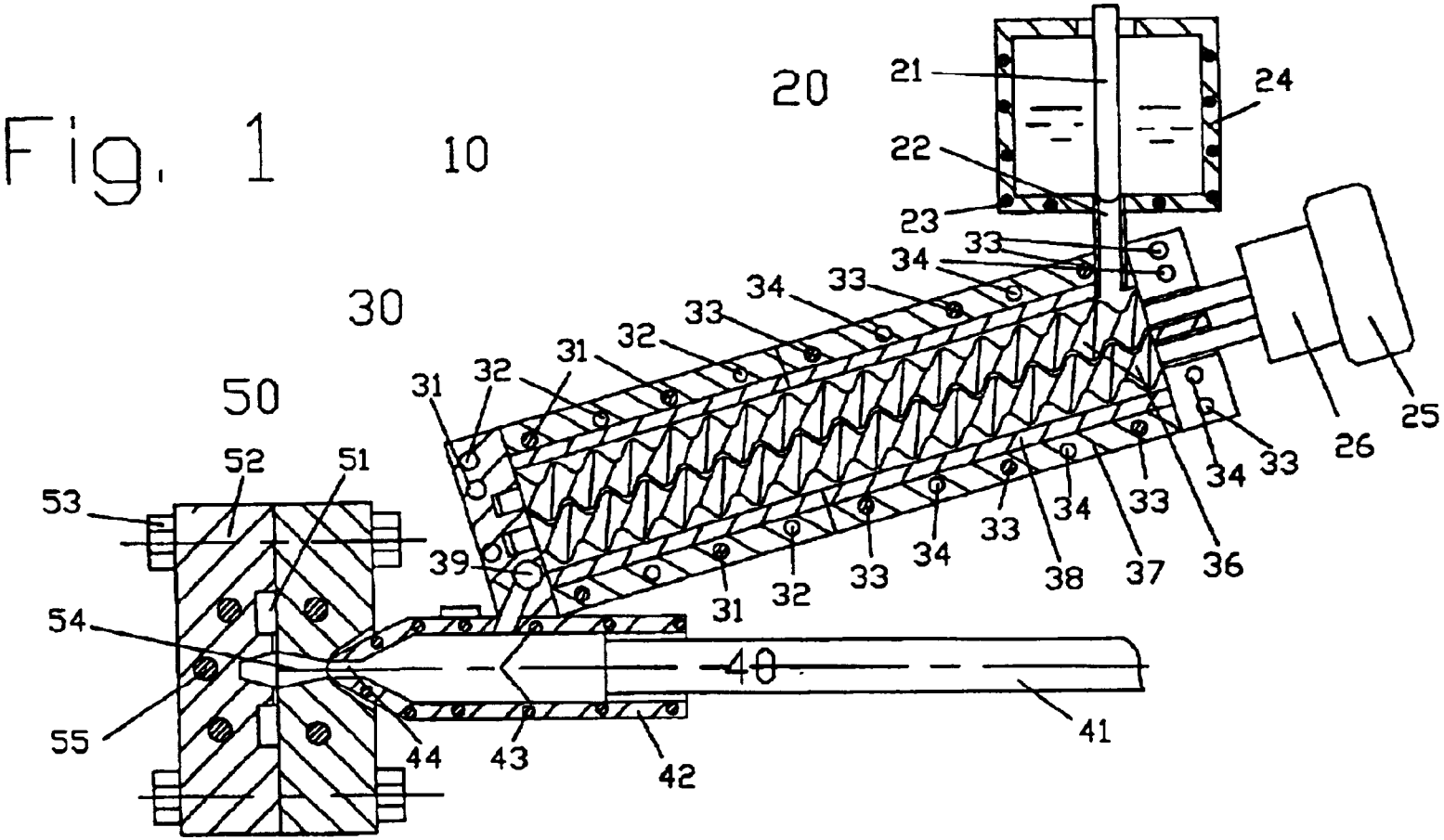
FIG. 1 is a schematic illustration of an embodiment of an apparatus for converting liquid alloys into a thixotropic slurry and for producing high integrity components according to the principles of the present invention.

FIG. 1 illustrates a twin-screw rheomolding system 10 according to an embodiment of this invention. The system 10 has four sections: a feeder 20, a twin-screw extruder 30, a shot assembly 40 and a mold clamping unit 50. A liquid alloy is supplied to the feeder 20. The feeder 20 is provided with a plunger 21, a socket 22 and a series of heating elements 23 disposed around the outer periphery of the crucible 24. The heating elements 23 may be of any conventional type and operates to maintain the feeder 20 at a temperature high enough to keep the alloy supplied through the feeder 20 in the liquid state. For Al-alloys, this temperature would be over 600° C. The liquid alloy is subsequently fed into the twin-screw extruder 30 by way of gravity when the plunger 21 is optionally raised.

The extruder 30 has a plurality of heating elements 31, 33 and cooling elements 32, 34 dispersed along the length of the extruder 30. The matched heating elements 31, 33 and cooling channels 32, 34 form a series of heating and cooling zones respectively. The heating and cooling zones maintain the extruder at the desired temperature, for semisolid processing. For a rheomolding system 10 designed for Al-alloys, heating elements 33 and cooling channels 34 would maintain the top part of the extruder at a temperature of about 585° C.; and heating elements 31 and cooling channels 32 would maintain the bottom part of the extruder at a temperature of about 590° C. The heating and cooling zones also make it possible to maintain a complex temperature profile along the extruder axis, which may be necessary to achieve certain microstructural effects during semisolid processing. The temperature control of each individual zone is achieved by balancing the heating and cooling power inputs by a central control system. The methods of heating can be resistance heating, induction heating or any other means of heating. The cooling media may be water, gas or mist depending on the processing requirement. While only two heating/cooling zones are shown in FIG. 1, the extruder 30 can be equipped with from 1 to 10 separately controllable heating/cooling zones.

The extruder 30 also has a physical slope or an inclination. The inclination is usually from 0 to 90° and preferably from 20 to 90° relative to the shot direction. The inclination is designed to assist the transfer of semisolid alloy from the extruder 30 to the shot sleeve 42.

The extruder 30 is also provided with twin-screw 36 which is driven by an electric motor or hydraulic motor 25 through a gear box 26. The twin-screw 36 is designed to provide high shear rate which is necessary to achieve fine and uniformly distributed solid particles. Different types of screw profiles may of course be used. In addition, any device which offers high shear mixing and positive displacement pumping actions may also be used to replace the twin-screw.

The thixotropic alloy exits the extruder 30 into a shot assembly 40 through a valve 39. The valve 39 operates in response to a signal from the central control system. The optional opening of valve 39 should match the process requirements. Injection of the thixotropic alloy is made by a piston 41 positioned in the shot sleeve 42 through hole 44 into a mold cavity 51. The position and velocity of piston 41 are adjustable to suit the requirement by different processes, materials and final components. Generally, the shot speed should be high enough to provide enough fluidity for complete mold filling, but not too high to cause air entrapment.

As shown in FIG. 1, heating element 43 is also provided along the length of the shot sleeve 42. In the preferred embodiment of the rheomolding system for processing Al-alloys, the shot sleeve is preferably maintained at a temperature close to the extruder temperature to maintain the alloy in its predetermined semisolid state.

The mold clamp 50 is used to form mold cavity 51. Therefore, it preferably consists of two half dies 52, fasten elements 53, the running system 54 and the heating elements 55 to keep the dies at a required temperature.

Figure 2:
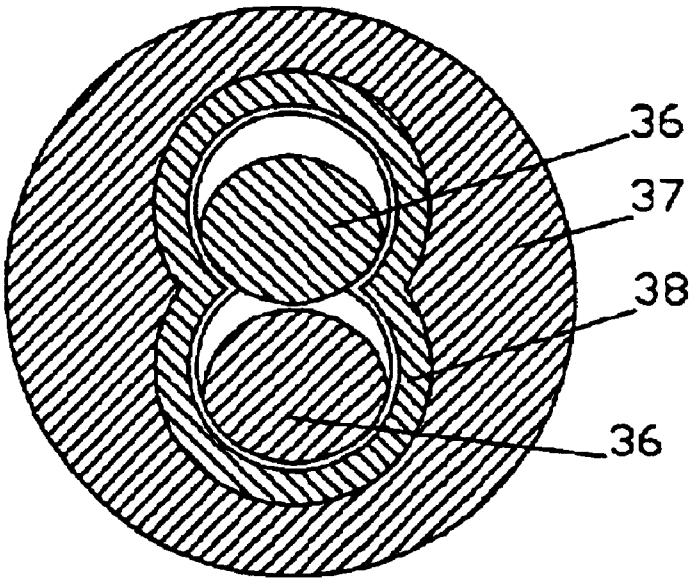
FIG. 2 is a schematic cross-sectional view of the twin-screw barrel according to the principles of the present invention.

FIG. 2 is a schematic sectional illustration of the barrel as used in the preferred embodiments, which consists of an outer steel shell 37 and a sialon liner 38. The sialon liner 38 can be shrink fitted into the outer shell 37 by the different coefficients during thermal expansion. The temperature for shrink fitting the cold sialon liner 38 into the heated steel shell is chosen in such a way that a tight fit between the barrel and its liner is achieved at the processing temperature to guarantee efficiency of heat transfer. The sialon is chosen here as the barrel liner to provides good wear, corrosion and erosion resistance, while retaining the necessary strength and toughness at the processing temperature. For barrels of small size, a one piece (integral) sialon construction may be utilized.

Figure 3:
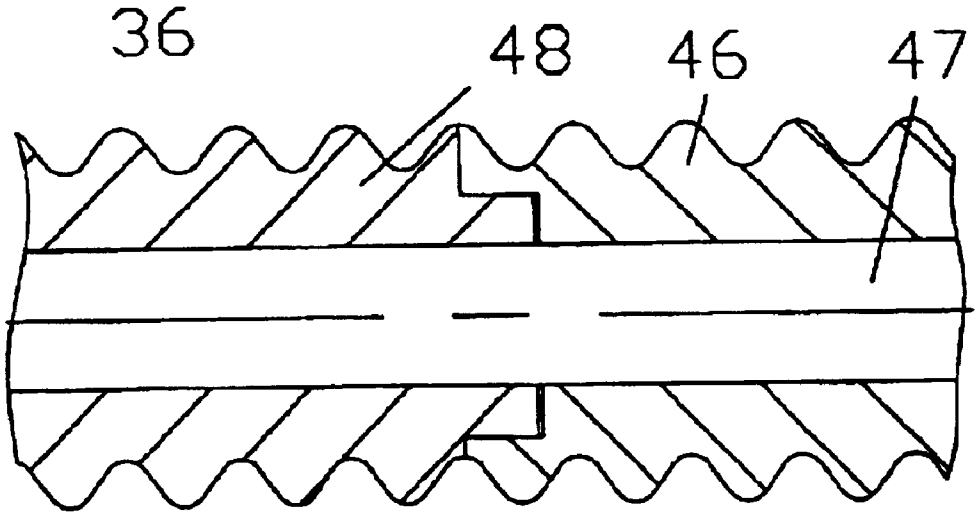
FIG. 3 is a sectional illustration of a screw constructed according to the principles of the present invention.

FIG. 3 is a sectional illustration of a screw constructed according to the principles of the present invention. The screw 36 for the rheomolding system 10 can be fabricated as a mechanical assembly of sialon screw sections with proper profiles. Components 46, 48 with the desired profile are assembled together and then installed onto a shaft 47 with the required alignment. Preferably, a tight assembly with a small tolerance is employed. For small size screws, a monolithic sialon screw could be utilized.

Figure 4:
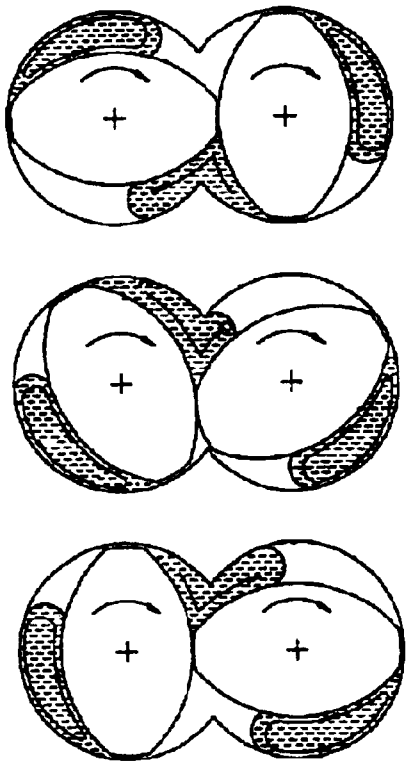
FIG. 4 is a schematic illustration of sectional flow of semisolid slurry in a twin-screw extruder.
Figure 5:
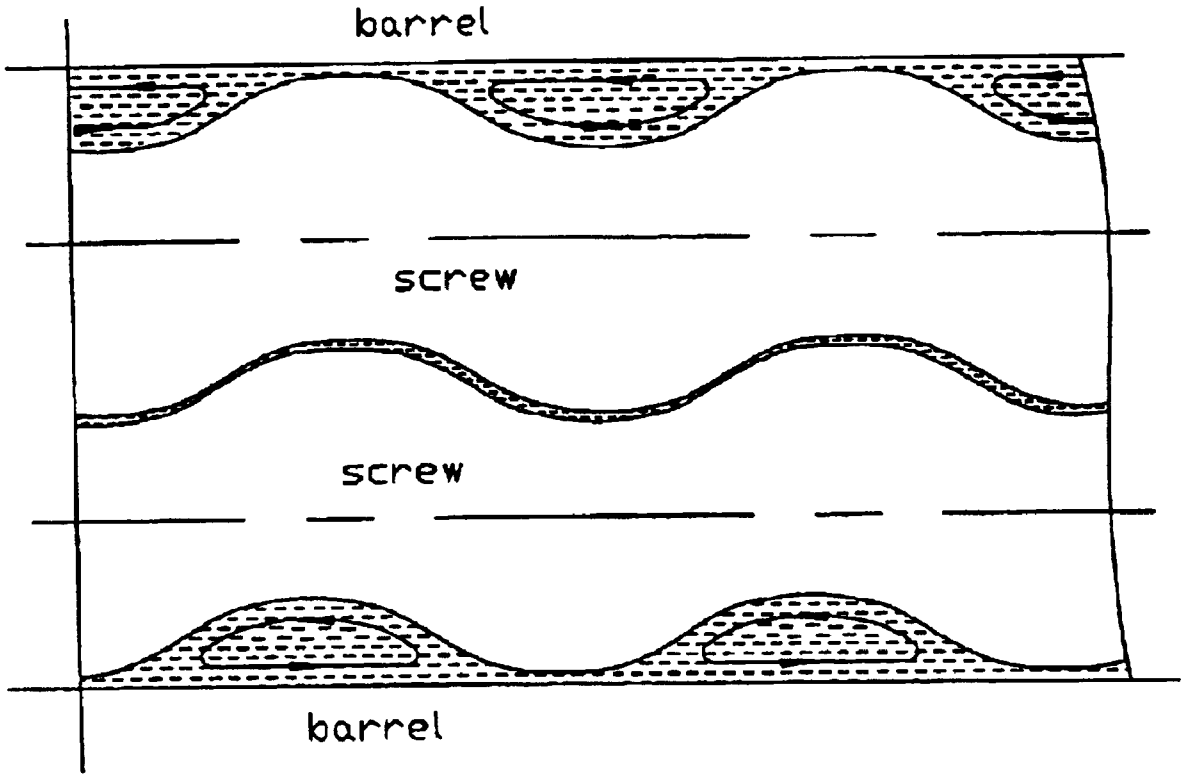
FIG. 5 is a schematic illustration of axial flow of semi-solid slurry in a twin-screw extruder.

FIGS. 4 and 5 respectively illustrate the sectional and axial fluid flow in a twin screw extruder according to the present invention.

Figure 6:
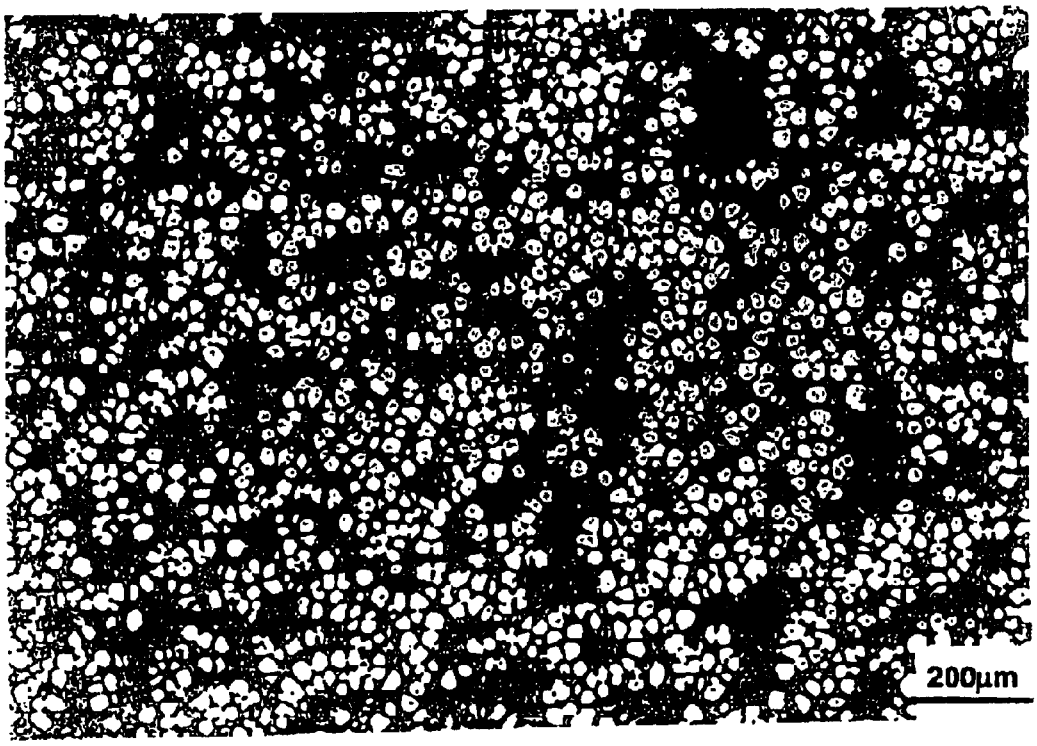
FIG. 6 shows the microstructures of theomolded Mg-30 wt. % Zn alloys of different volume fractions.

FIG. 6 illustrates a microstructure of one semisolid alloy of Mg-30 wt. % Zn produced by said apparatus. Specifically, the photograph illustrates the microstructure of an alloy having 40% solid fraction, which confirms that the inventive rheomolding process is capable of producing semisolid with fine and uniformly distributed particles.

Figure 7:
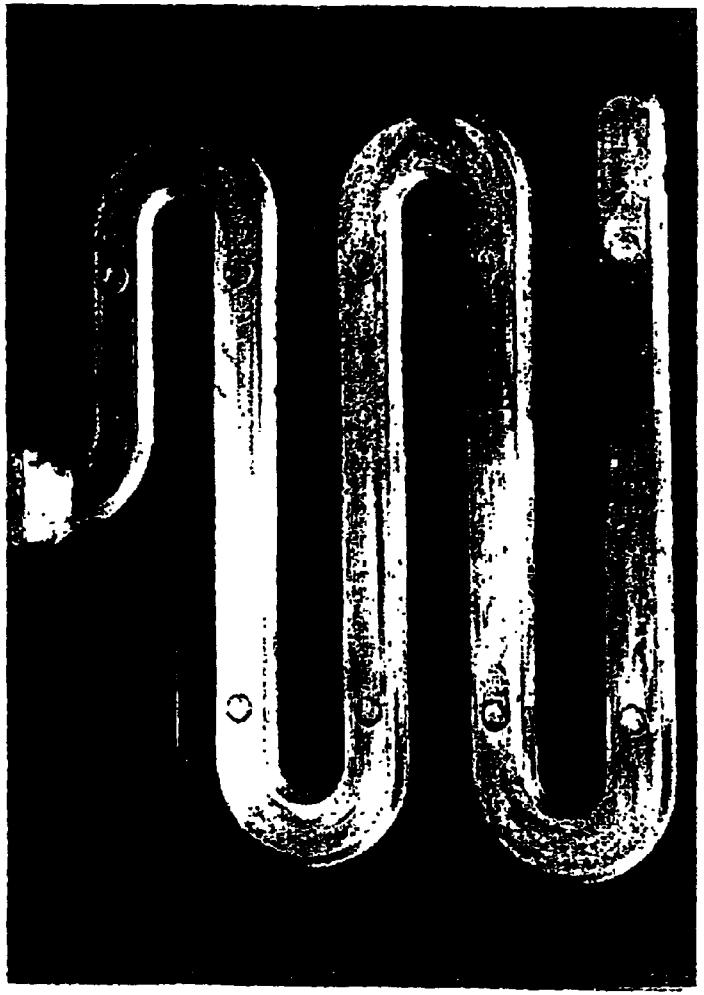
FIG. 7 is a photograph of a rheomolded casting formed according to the present invention.

FIG. 7 illustrates a casting produced by said apparatus from an alloy of Mg-30 wt. % Zn. Testing confirms that the produced casting has lower porosity than that of conventional castings.

The embodiment may also contain a device attached to the feeder 20 to apply pressure to the liquid alloy for the supply of liquid alloy from feeder 20 to extruder 30 when the feeder 20 is positioned below the extruder 30. Such a pressure should be accurately controlled to ensure that the right amount of liquid alloy flows from feeder 20 to the extruder 30.

The embodiment may also contain a device attached to the feeder 20, extruder 30, shot assembly 40 and mold clamp 50 to supply protective gas in order to minimize oxidation. Such a gas may be argon, nitrogen or any other appropriate gas.

Generally, the rheomolding system has a control device to control all functions. Preferably, the control device is programmable so that the desired solid volume in the semisolid state may be achieved easily. The control system (not shown in FIG. 1) may, for example, comprise a microprocessor which may easily and quickly be reprogrammed to change the processing parameters.

EXAMPLE

Industrially pure magnesium and zinc with >99% purity were used to form a Mg-30 wt. % Zn melt in the furnace. The melt was kept in a graphite crucible at a predetermined temperature with 20° C. overheat. The melt was then feed into the extruder at 410° C. and sheared at a rate of 1000 $s^{-1}$ for 20 seconds to convert the melt into a semisolid slurry.

The semisolid slurry was then transferred into the shot assembly by opening the valve at one end of extruder and subsequently moving the piston forward to inject the semisolid slurry into the temperature controlled die. After it was completely cooled, the casting (FIG. 7) was released from the die. The sample was cut from casting and a standard metallograpical technique was used to grind and polish. Microstructural examination was carried out using optical microscope and the result was shown in FIG. 6, in which the particle is the primary phase solidified and sheared in the extruder.

While the particular embodiment according to the invention has been illustrated and described above, it will be clear that the invention can take a variety of forms and embodiments within the scope of the appended claims.

What is claimed is:

1. A method for forming a shaped component from liquid metal alloy, comprising the steps of:

a. cooling the alloy to a temperature below its liquidus temperature while applying shear at a sufficiently high shear rate and intensity of turbulence to convert the alloy into its thixotropic state, and b. subsequently transferring the alloy into a mold to form a shaped component, wherein shear is applied to the alloy by means of an extruder having at least two screws which are at least partially intermeshed.

2. A method as claimed in claim 1, wherein the screws are substantially fully intermeshed.

3. A method as claimed in claim 1, wherein the alloy is fed into the extruder at a temperature higher than its liquidus temperature.

4. A method as claimed in claim 1, wherein, prior to being transferred into the mold, the alloy is transferred into a shot assembly which injects the alloy into the mold.

5. A method as claimed in claim 1, wherein the temperature of the alloy while it is being sheared is maintained between the liquidus and solidus temperatures of the alloy, such that the alloy is in a semisolid state.

6. A method as claimed in claim 5, wherein the solid volume fraction in the alloy while it is in the extruder is from 5 to 95%.

7. Apparatus for forming a shaped component from liquid metal alloy, comprising:

a. a temperature-controlled extruder able to impart sufficient shear and intensity of turbulence to a liquid metal alloy to convert it into its thixotropic state, b. a shot assembly in fluid communication with the extruder, and c. a mold in fluid communication with the shot assembly, wherein the extruder has at least two screws which are at least partially intermeshed.

8. Apparatus as claimed in claim 7, additionally comprising a feeder for feeding the liquid metal alloy into the extruder.

9. Apparatus as claimed in claim 8, wherein the feeder has means for containing and maintaining the alloy at a temperature above the liquidus temperature.

10. Apparatus as claimed in claim 7, wherein the extruder has a barrel and a pair of screws, the inner surface of said barrel and the outer surface of said screws are resistant to corrosion and erosion by liquid alloys, said screws each including a shaft having at least one vane thereon, said vane at least partially defining a helix around said shaft to propel the alloy through said barrel.

11. Apparatus as claimed in claim 7, having an electric or hydraulic motor for rotating said screws and shearing said alloy at a shear rate and intensity of turbulence sufficient to inhibit complete formation of dendritic structures therein while said alloy is in a semisolid state, the rotation of said screws by said electric or hydraulic motor also causing said alloy to be transported from one end to another end of said barrel.

12. Apparatus as claimed in claim 7, including temperature controllable means for transferring heat to said barrel, said screws and said alloy, such that said alloy is in a semisolid state and at a temperature between the liquidus and solidus temperatures of said alloy.

13. Apparatus as claimed in claim 7, including a control valve between the extruder and the shot assembly for discharging said alloy from said extruder to a shot sleeve in a cylinder-piston assembly.

14. Apparatus as claimed in 7, wherein the extruder barrel has an inner layer is mechanically bonded to an outer layer of said barrel by shrink fitting.

15. Apparatus as claimed in claim 7, wherein said extruder barrel is a monolithic component formed from sialon ceramic.

16. Apparatus as claimed in claim 7, wherein all surfaces and the inner layer of said apparatus in contact with the semisolid alloy are formed from sialon ceramic.

17. Apparatus as claimed in claim 7 wherein said outer layer of said barrel is tool steel H11, H13 or H21.

18. Apparatus as claimed in claim 7, wherein said screw is mechanically bonded sialon screw sections by shrink fit.

19. Apparatus as claimed in claim 7, wherein said screw is a monolithic construction of sialon ceramic.

20. A method of forming a semisolid slurry from a liquid metal alloy, comprising the steps of cooling the alloy below its liquidus temperature while applying shear at a sufficiently high shear rate and intensity of turbulence to convert the alloy into its thixotropic state, wherein shear is applied to the alloy by means of an extruder having at least two screws which are at least partially intermeshed.

21. A method as claimed in claim 1, wherein shear is applied to the alloy at a rate of at least 400 $s^{-1}$.

22. A method as claimed in claim 1, wherein shear is applied to the alloy at a rate from 5,000–10,000 $s^{-1}$.

23. A method as claimed in claim 20, wherein shear is applied to the alloy at a rate of at least 400 $s^{-1}$.

24. A method as claimed in claim 20, wherein shear is applied to the alloy at a rate from 5,000–10,000 $s^{-1}$.

* * * * *